US007540366B2

(12) United States Patent
Lindberg

(10) Patent No.: US 7,540,366 B2
(45) Date of Patent: Jun. 2, 2009

(54) METHOD FOR CENTERING OF ROLLS

(75) Inventor: Harri Lindberg, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 195 days.

(21) Appl. No.: 11/578,403

(22) PCT Filed: Apr. 11, 2005

(86) PCT No.: PCT/FI2005/000180

§ 371 (c)(1),
(2), (4) Date: Dec. 21, 2006

(87) PCT Pub. No.: WO2005/100159

PCT Pub. Date: Oct. 27, 2005

(65) Prior Publication Data

US 2008/0034714 A1 Feb. 14, 2008

(30) Foreign Application Priority Data

Apr. 14, 2004 (FI) ..... 20040538

(51) Int. Cl.
*B65G 43/00* (2006.01)

(52) U.S. Cl. ..... 198/341.05; 198/617; 198/346.2; 198/502.3

(58) Field of Classification Search ..... 198/617, 198/341.05, 345.1, 346.2, 346.3, 406, 502.3
See application file for complete search history.

(56) References Cited

U.S. PATENT DOCUMENTS 3,342,014 A 9/1967 Prager
3,757,961 A * 9/1973 Jacobs ..... 198/621.1
4,982,553 A * 1/1991 Itoh ..... 53/246
5,142,975 A * 9/1992 Podalsky et al. ..... 101/40.1
5,265,399 A 11/1993 Niskanen et al.
5,471,924 A * 12/1995 Helling ..... 101/38.1
6,409,438 B1 * 6/2002 Kohler ..... 409/131
6,826,821 B2 * 12/2004 Geiger et al. ..... 29/563
7,410,340 B2 * 8/2008 Bonora et al. ..... 414/217.1

FOREIGN PATENT DOCUMENTS

CN 1421359 A 6/2003
FI 57561 5/1980
FI 89149 9/1996
GB 2044713 10/2006

* cited by examiner

*Primary Examiner*—Douglas A Hess
(74) *Attorney, Agent, or Firm*—Cohen Pontani Lieberman & Pavane LLP

(57) ABSTRACT

The invention relates to a method for moving paper, board and cellulosic web rolls in a roll packaging system having a plurality of roll handling stations and at least one indexing conveyor capable of operating on at least two elevation levels. According to the method, the rolls are moved in the packaging system by an indexing conveyor car, which is adapted to move synchronously at each roll handling station. The car is moved in a return motion when the indexing conveyor car is in its lowermost position. The position of the roll is measured. At least one roll is admitted onto the indexing conveyor car while having the car driven into its lowermost position (base elevation level 0) and the roll is transferred by the movement of the indexing conveyor car driven into its base elevation level 0 in such a fashion that the roll is positioned into an appropriate position in regard to the function of the roll handling stations for moving the rolls to the roll handling stations.

8 Claims, 5 Drawing Sheets

METHOD FOR CENTERING OF ROLLS

PRIORITY CLAIM

Figure 1:
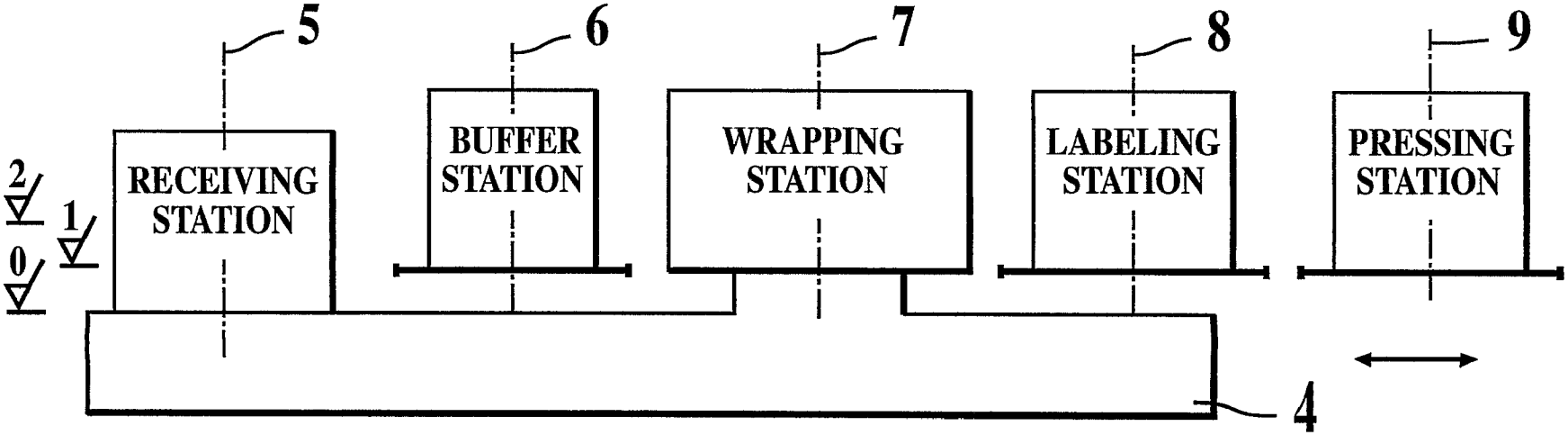

This is a national stage of PCT application No. PCT/FI2005/000180, filed on Apr. 11, 2005. Priority is claimed on application No. 20040538 filed in Finland on Apr. 14, 2004.

The present invention relates to a method according to the preamble of claim 1 for centering rolls of paper, board and cellulose in a roll packaging system during wrapper winding, label attachment and header placement.

The papermaking industry generally uses a packaging method wherein inner headers are first placed on the ends of a roll to be packaged, next a wrapper is wound about the roll and finally the outer headers are placed on the roll ends. The packaging cycle and system themselves can be implemented in different ways and, typically, the packaging system is tailored to the needs of the mill. The different packaging functions are performed at separate stations and the roll can be transferred between the stations, e.g., on an indexing conveyor car. The indexing conveyor has separate stations for each packaging step: roll entry, buffer, wrapping, labeling and placement of outer headers, whereby one indexing conveyor car is located at each one of the stations. The car or cars are reciprocatingly moved between the stations so that after a car has moved a roll to the next station, the car is/are returned to its "home" position to be ready to receive a new roll to be transferred. To move the rolls forward, the indexing conveyor of the car(s) is moved upward, whereby the rolls thereon are elevated from the support rollers or support means of the station. Since the car is integrated or the cars are connected to each other, the rolls move thereby simultaneously.

In order to make the system operate in a desired fashion, the rolls must enter the separate roll handling stations in a precisely timed fashion. Accordingly, the indexing conveyor is preceded by a centering station, where the roll is moved longitudinally so as to permit is transfer by a lateral movement into a correct position onto the indexing conveyor car. The transfer of the roll onto the indexing conveyor can be performed in either a centered or offset fashion so that the transfer movement aligns the center point of the roll with the centerline of the stations. Precise centering alignment is extremely crucial to guarantee full functionality of packaging operations performed on the roll.

It is an object of the present invention to provide a method making a separate centering station redundant.

The goal of the invention is attained by receiving the roll entering the indexing conveyor when the car top surface is at its lowermost elevation level and then transferring the roll by the movement of the indexing conveyor to the appropriate location defined as a function of roll packaging stations and to be moved to packaging stations.

More specifically, the method according to the invention is characterized by what is stated in the characterizing part of appended claim 1.

The invention provides significant benefits.

By virtue of the invention, the equipment costs of one packaging function can be eliminated. The overall conveyor travel may be shortened and the footprint needed by the packaging system is reduced. The method is applicable to existing indexing conveyors through minimal modifications. To implement the method, only sensors of roll position must be installed at the receiving station of indexing conveyor or in any suitable location preceding the station.

Figure 2:
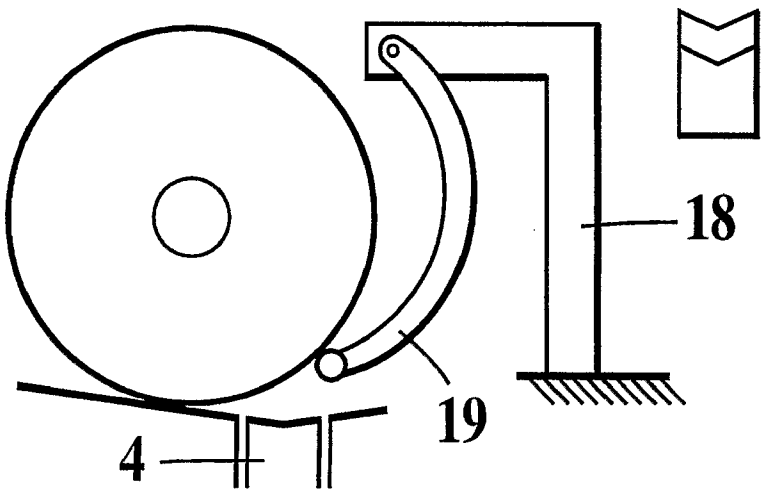
Figure 3:
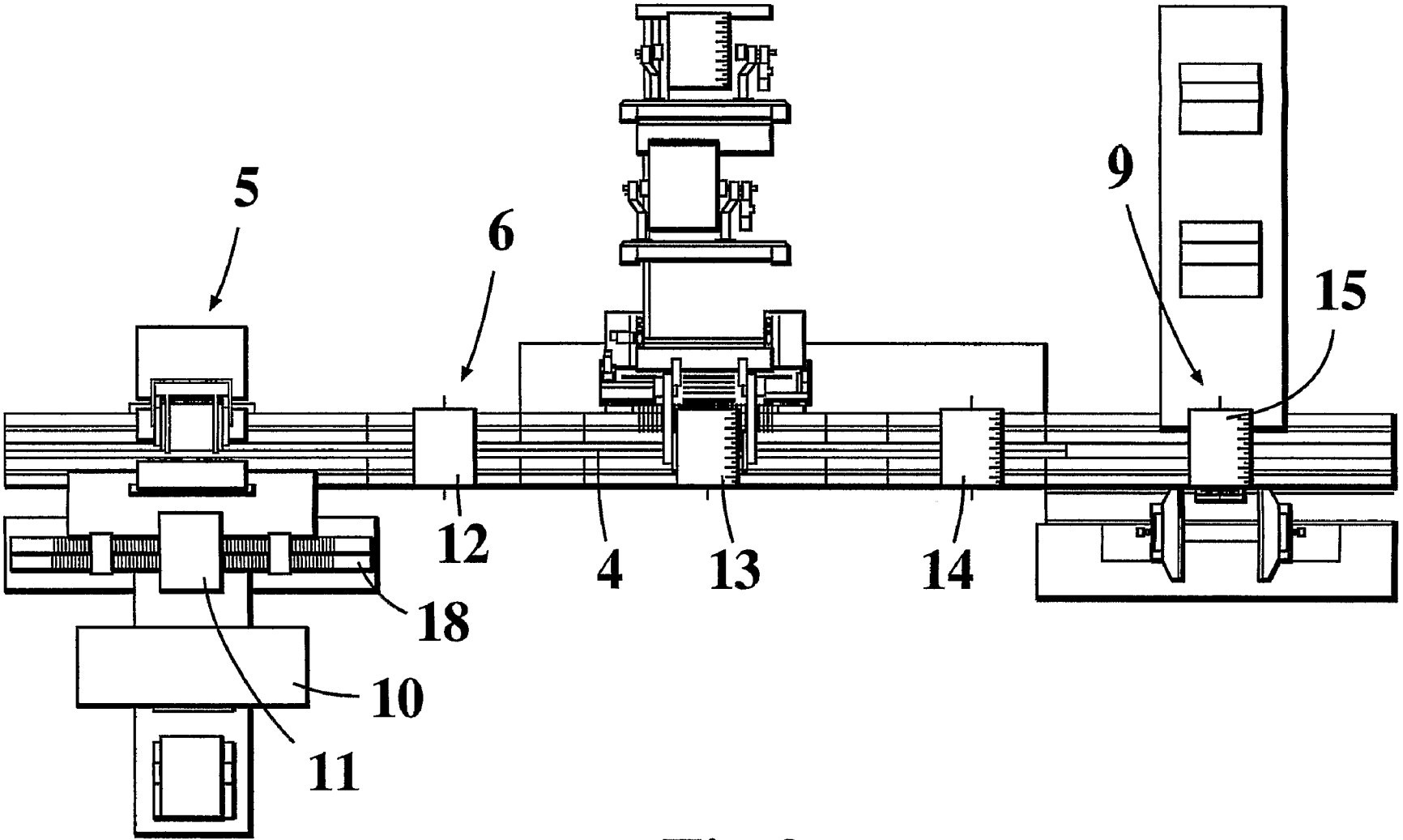
Figure 4:
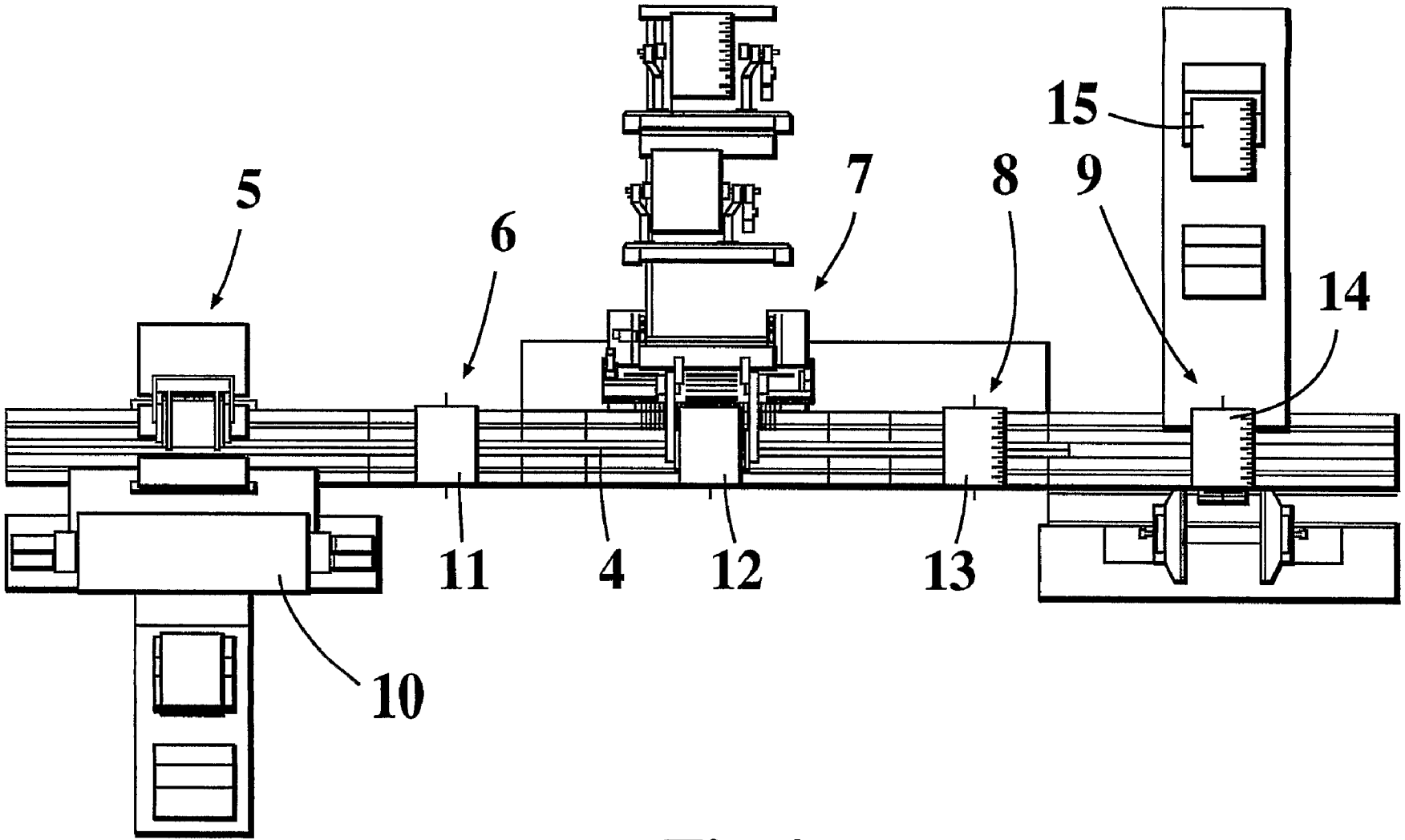
Figure 5:
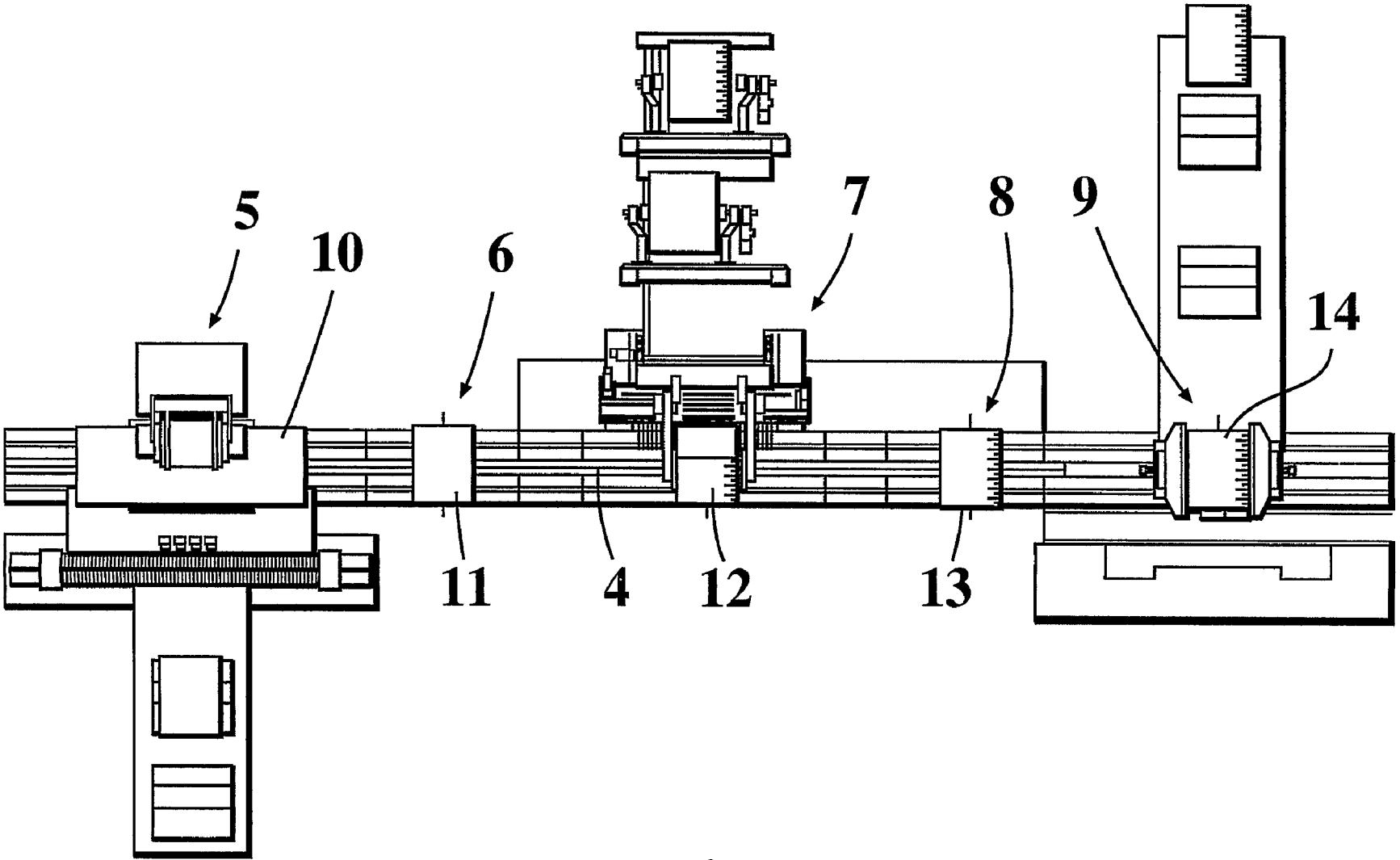
Figure 6:
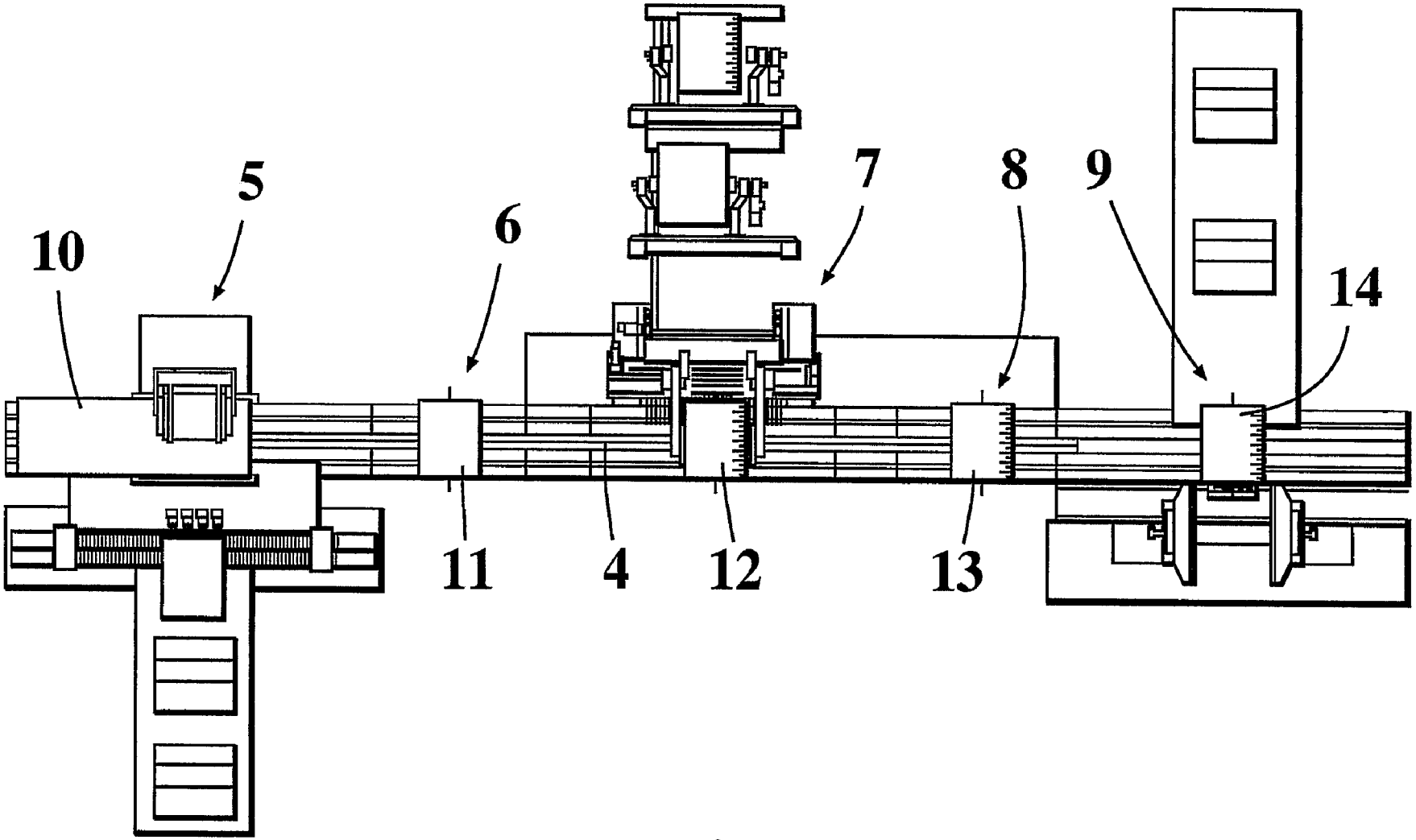

In the following, the invention is examined in more detail with the help of the appended diagrams. The drawing and description thereof illustrate a novel kind of packaging arrangement suited for overlap wrapping, However, the invention is not limited by the exemplary embodiment discussed below, but rather may also be used in conjunction with conventional indexing conveyors operating at two elevation levels. In the drawing, FIG. 1 schematically shows a side elevation view of an indexing conveyor system;

FIG. 2 shows an embodiment of a receiving station;

FIG. 3 schematically shows a top view of an assembly according to the invention in its first operating stage;

FIG. 4 schematically shows a top view of the assembly according to the invention in its second operating stage;

FIG. 5 schematically shows a top view of the assembly according to the invention in its third operating stage; and FIG. 6 schematically shows a top view of the assembly according to the invention in its fourth operating stage.

Referring to FIG. 1, therein is illustrated the multiple elevation principle of the invention. A car 4 of an indexing conveyor is adapted adjustable at three different heights later in the text called elevation levels. Along the length of one car 4 of the indexing conveyor are situated five packaging system stations: receiving station 5, buffer station 6, wrapping station 7, labeling station 8 and header placement/roll ejection station 9. The lowest elevation level 0 is the so-called base level on which rolls being handled at the receiving station 5 can be moved with the other rolls staying stationary. At the first elevation level 1, the roll located at the wrapping station may be moved with all the other rolls staying stationary and, at the second elevation level 2, all the rolls are elevated to the car 4 of the indexing conveyor, whereby they move synchronously.

At the receiving station 5, a roll to be placed on the conveyor is positioned differently depending on whether the roll shall be wrapped into a single wrapper or whether it needs overlap wrapping, whereby plural adjacent wrapper courses must be wound thereon. For this position operation, the receiving station 5 is provided with a parallelogram mechanism suited to elevate and lower the roll in regard to the car 4 of the indexing conveyor. Respectively, the wrapping station 7 must have equivalent means for moving one roll without simultaneously causing uncontrolled movement of other rolls. To this end, the top level of the car 4 is elevated at the wrapping station to a higher position in regard to the car top level elevation at the other stations. Additionally, each station is provided with support rollers or support means on which the rolls can be lowered in situations requiring the car 4 of the indexing conveyor to be moved, e.g., during the return movement of car 4, without disturbing the positions of the other rolls. The positioning of the rolls at the stations can be performed in either a centered or offset fashion. In the present text, centered positioning refers to a roll position having its center point in the lateral dimension of the roll being aligned with the centerline of the station, while offset positioning refers to any roll position having the roll center point shifted into an offset position from the centered position.

Next, the invention is discussed in greater detail with the help of FIGS. 3-6. This sequence of diagrams illustrates the travel of a wide roll in the packaging system as the roll is being wrapped using three-wide overlap wrapping. In FIG. 3, a roll 10 to be taken to overlap wrapping is shown entering the receiving station 5 of the centering station 18. Preceding the roll to be overlap wrapped, other rolls to be single-wrapper packaged are roll 11 entering the receiving station, roll 12 at the buffer station 6 situated downstream from the receiving station 5, roll 13 at the wrapping station 7, roll 14 at the labeling station 8 and roll 15 at the pressing station 9 waiting for the placement of the roll headers. During the following step, a roll 11 is taken to the receiving station 5, wherein the roll position is centered. Next, the car 4 of the indexing conveyor is elevated by two level shifts, whereby rolls at all stations are raised upward thus allowing the rolls to be moved forward. After the movement of car 4 in the indexing conveyor has been completed, the situation is as shown in FIG. 4, where the receiving station 5 is empty and the other stations have rolls 11-14 to be packaged in a single wrapper waiting in a centered position. The receiving station 5 is shown ready for the entry of roll 10 to be overlap wrapped. The roll 10 to be overlap wrapped is still at the centering station 18, where it is positioned in regard to its longitudinal direction so that the roll 10 can be lowered into the proper position on the car 4 of the indexing conveyor. This centering step is necessary to guarantee correct positioning of the roll at the packaging stations. When a roll to be overlap wrapped enters the receiving station 5, the supporting means of the roll are driven to their lower positions and the roll to be overlap wrapped is lowered directly onto the car 4 of the indexing conveyor. This situation is shown in FIG. 5. As the car 4 of the indexing conveyor is at the base elevation level, that is, in its lowest position, the roll situated at the receiving station 5 can be moved. The roll 10 to be overlap wrapped is next moved by the indexing conveyor into a position, wherein the roll enters correctly located for wrapping: the roll 10 is moved backward so that the roll entering the wrapping station 7 has its end properly positioned in regard to the wrapper edge for winding the first wrapper course. This situation is shown in FIG. 6.

The function of the above-described system is still continued through plural stages, but inasmuch as the subsequent steps are irrelevant as to the present invention, further discussion of the system operation may be omitted herein.

As mentioned above, a roll entering the indexing conveyor is centered and typically located in a given position on the indexing conveyor at the centering station 18. Hence, the method according to the present invention disposes with the need for a centering station. Instead, the roll is taken directly to the indexing conveyor car driven to the base level 0, whereby the roll position is measured with the help of a laser position sensor at one end of the roll, for instance. The roll position can be measured while the roll is waiting to enter the receiving station, entering the same or, as late as, already residing at the receiving station. Knowing the positions of the roll and the indexing conveyor car, the measurement data can be used for controlling the indexing conveyor car such that either the roll is centered or moved into a desired offset position, e.g., for overlap wrapping. On the station at which the roll enters the car, the roll supporting means delivering the roll onto the car are driven to a lower elevation level than the roll supporting means of the other stations, whereby indexing conveyor driven to the base elevation level can be used for the transfer of a single roll alone. During this roll transfer step, all the other rolls rest on the supporting means or rollers of their respective stations thus allowing the indexing conveyor car to move freely thereunder. By raising the indexing conveyor upward, all the rolls situated above the indexing conveyor car become supported by the car thus permitting transfer thereof. Hereby all the rolls move in synchronism.

The receiving station can be equipped with a loading/elevating apparatus based on a parallelogram mechanism such as is disclosed in Canadian patent No. 2,003,605. If the capacity need is not excessively high requiring the maximally fast operating speed, the arrangement shown in FIG. 2 may be used. Herein, the roll is manipulated by means of a top-side receiver comprising a frame 18 and a receiver arm 19. The arm 19 serves to retard the motion of the roll and stop the roll on the car of the indexing conveyor. When the car 4 of the indexing conveyor must be moved without disturbing the positioning of the roll, the receiver arm can be actuated to unload the roll from the car and reload it back onto the car after the movement thereof is at a standstill. Thus, this arrangement provides the same function as a loading/unloading apparatus. The position of the arm may be monitored by means of an absolute position sensor, whereby a roll entering a station can be positioned accurately beside the indexing conveyor. Then, lowering the roll onto the car needs only a minimal transfer movement resulting in a short cycle time increment. Roll diameter and position sensor signals must be available for roll positioning. Based on this information, the roll position at the side of the can be computed. Obviously, a bottom-side receiver can be used in lieu of the top-side receiver.

In the above text, a system has been described comprising five separate roll handling stations. Obviously, the number of roll handling stations can be varied according to the number of roll packaging and handling stages required in the system. The car of the wrapping station can be a single, contiguous car or, alternatively, it may comprise a number of connected and thus jointly moving separate cars. Prepositioning for overlap wrapping can be performed at any station when the conveyor is operating at its base level 0. Since the roll is anyhow moved at the receiving station for centering, the prepositioning movement is most advantageously carried out there. Alternatively, the roll may be taken to the wrapping station ready centered, whereby the roll end is positioned at the wrapping station for the first wrapping stage before starting wrapping. The operating strategy is selected so that the system gives sufficient and optimal packaging capacity in a particular operating environment.

What is claimed is:

1. A method for moving paper, board and cellulosic web rolls in a roll packaging system including a plurality of roll handling stations and at least one indexing conveyor capable of operating on at least two elevation levels, the method comprising the steps of:

moving the rolls in the system by means of a car of the indexing conveyor, the car being adapted to move synchronously at the roll handling stations;

admitting at least one roll onto the car of the indexing conveyor at a receiving station while the car is driven into a lowermost position; and measuring a position of the roll prior to its entry into the receiving station;

wherein when the car of the indexing conveyor is driven into the lowermost position, the roll is moved by the car into an appropriate position in regard to the function of the roll handling stations for moving the rolls to the roll handling stations.

2. The method of claim 1, wherein the roll is centered by a movement of the indexing conveyor.

3. The method of claim 1, wherein the roll is offset by a movement of the indexing conveyor.

4. The method of claim 1, wherein indexing conveyor is operable to move the rolls in a conveying direction of the packaging system, and wherein when the car of the indexing conveyor is driven into the lowermost position, the roll is moved by the car opposite to the conveying direction.

5. A method for moving paper, board and cellulosic web rolls in a roll packaging system including a plurality of roll handling stations and at least one indexing conveyor capable of operating on at least two elevation levels, the method comprising:

moving the rolls in the packaging system by a car of the indexing conveyor, the car being adapted to move synchronously at the roll handling stations;

admitting at least one roll onto the car of the indexing conveyor at a receiving station while the car is driven into a lowermost position; and measuring a position of the roll while the roll resides at the receiving station;

wherein when the car of the indexing conveyor is driven into the lowermost position, the roll is moved by the car to an appropriately position in regard to a function of the roll handling stations for moving the rolls to the roll handling stations.

6. The method of claim 5, wherein the roll is centered by a movement of the indexing conveyor.

7. The method of claim 5, wherein the roll is offset by a movement of the indexing conveyor.

8. The method of claim 5, wherein indexing conveyor is operable to move the rolls in a conveying direction of the packaging system, and wherein when the car of the indexing conveyor is driven into the lowermost position, the roll is moved by the car opposite to the conveying direction.

* * * * *